US010419848B2

(12) United States Patent
Choi et al.

(10) Patent No.: US 10,419,848 B2
(45) Date of Patent: Sep. 17, 2019

(54) MICROSPEAKER ENCLOSURE WITH POROUS MATERIALS IN RESONANCE SPACE

(71) Applicant: EM-TECH. Co., Ltd., Busan (KR)

(72) Inventors: Kyu Dong Choi, Gyeongsangnam-do (KR); Seul Ki Nam, Gyeongsangnam-do (KR); Heung Woo Jeong, Gyeongsangnam-do (KR)

(73) Assignee: EM-TECH. Co., Ltd., Busan (KR)

( * ) Notice: Subject to any disclaimer, the term of this patent is extended or adjusted under 35 U.S.C. 154(b) by 83 days.

(21) Appl. No.: 15/617,603

(22) Filed: Jun. 8, 2017

(65) Prior Publication Data

US 2017/0359649 A1 Dec. 14, 2017

(30) Foreign Application Priority Data

Jun. 9, 2016 (KR) ..... 10-2016-0071908

(51) Int. Cl.

| | |
|---|---|
| ***H04R 25/00*** | (2006.01) |
| ***H04R 1/28*** | (2006.01) |
| ***H04R 1/02*** | (2006.01) |
| ***H04R 31/00*** | (2006.01) |

(52) U.S. Cl.

CPC ..... *H04R 1/288* (2013.01); *H04R 1/025* (2013.01); *H04R 31/00* (2013.01); *H04R 2201/029* (2013.01); *H04R 2499/11* (2013.01)

(58) Field of Classification Search

CPC ..... H04R 1/288; H04R 1/025; H04R 31/00; H04R 2201/029; H04R 2499/11

USPC ..... 381/354

See application file for complete search history.

(56) References Cited

U.S. PATENT DOCUMENTS

| | | | | |
|---|---|---|---|---|
| 3,690,405 | A * | 9/1972 | Hance | H04R 1/2819 181/155 |
| 3,720,285 | A * | 3/1973 | Russell | H04R 1/288 181/151 |
| 3,786,202 | A * | 1/1974 | Schafft | H04R 17/00 310/324 |
| 4,152,552 | A * | 5/1979 | Meyer | H04R 1/30 181/159 |
| 4,439,644 | A * | 3/1984 | Bruney, III | G10K 11/002 181/151 |
| 4,742,887 | A * | 5/1988 | Yamagishi | H04R 1/2857 181/129 |
| 7,743,880 | B2 * | 6/2010 | Matsumura | B61D 17/185 181/151 |
| 7,953,240 | B2 * | 5/2011 | Matsumura | H04R 1/2803 381/150 |
| 8,687,836 | B2 | 4/2014 | Lin | |

(Continued)

FOREIGN PATENT DOCUMENTS

| | | | | |
|---|---|---|---|---|
| EP | 2424270 | A1 * | 2/2012 | B01J 20/18 |
| EP | 2424270 | B1 | 5/2014 | |

*Primary Examiner* — Phylesha Dabney

(74) *Attorney, Agent, or Firm* — Murphy, Bilak & Homiller, PLLC

(57) ABSTRACT

The present invention discloses a microspeaker enclosure with porous materials, including a microspeaker, an enclosure with the microspeaker therein, the enclosure defining a resonance space and having an upper casing and a lower casing, a sound absorber arranged in the resonance space and defining a space, and porous materials filled in the space defined by the sound absorber.

10 Claims, 5 Drawing Sheets

(56) References Cited

U.S. PATENT DOCUMENTS

| | | | | |
|---|---|---|---|---|
| 8,942,402 | B2 * | 1/2015 | Yuasa | H04R 1/02 381/332 |
| 2006/0269095 | A1 * | 11/2006 | Matsumura | H04R 1/2803 381/421 |
| 2008/0135327 | A1 * | 6/2008 | Matsumura | B61D 17/185 181/151 |
| 2008/0170737 | A1 * | 7/2008 | Saiki | H04R 1/2803 381/346 |
| 2014/0064540 | A1 * | 3/2014 | Lin | H04R 1/2803 381/346 |
| 2017/0208386 | A1 * | 7/2017 | Yang | H04R 1/22 |
| 2018/0027322 | A1 * | 1/2018 | Shi | H04R 1/288 381/353 |
| 2018/0124502 | A1 * | 5/2018 | Liu | G10K 11/162 |

* cited by examiner

MICROSPEAKER ENCLOSURE WITH POROUS MATERIALS IN RESONANCE SPACE

PRIORITY CLAIM

The present application claims priority to Korean Patent Application No. 10-2016-0071908 filed on 9 Jun. 2016, the content of said application incorporated herein by reference in its entirety.

TECHNICAL FIELD

The present invention relates to a microspeaker enclosure with porous materials in a resonance space, for increasing low-frequency sound pressure level (SPL) and decreasing low-frequency total harmonic distortion (THD).

BACKGROUND

A microspeaker is provided in a portable device, etc, to generate the sound. With recent developments of mobile devices, the microspeaker has been mounted in various mobile devices. In particular, the latest mobile devices tend to have a light weight, small size, and slim shape to facilitate portability, and accordingly, the microspeaker mounted in the mobile devices is required to have a small size and slim shape.

However, for a microspeaker having a small size and slim shape, an area of a diaphragm decreases, and a size of a resonance space, in which the sound generated by the vibration of the diaphragm is resonated and amplified, also decreases, as a result of which a sound pressure decreases. Such decrease in the sound pressure is particularly pronounced at low frequencies.

FIG. 1 illustrates one example of a conventional microspeaker enclosure. For the conventional microspeaker enclosure, a microspeaker A is mounted in a space defined in the enclosure by an upper casing 11 and a lower casing 12, and the remaining space, which is left after the mounting of the microspeaker A, is used as a resonance space (back volume). Here, a sound absorber 20 is arranged in the resonance space to restrict reflected waves of the sound generated by the microspeaker A, thereby preventing the distortion of the sound caused by standing waves.

FIG. 2 illustrates another example of the conventional microspeaker enclosure. In the conventional microspeaker enclosure of FIG. 2, a microspeaker A is mounted in a space defined in the enclosure by an upper casing 11 and a lower casing 12, and the remaining space, which is left after the mounting of the microspeaker A, is used as a resonance space (back volume). In the conventional microspeaker enclosure of FIG. 2, in order to overcome the reduction of the sound pressure, which results from the small size and slim shape, porous materials 30 are arranged in the resonance space to enhance a low-frequency sound pressure, such that the porous materials 30 adsorb air molecules to define a virtual acoustic space, which increases low-frequency SPL and decreases low-frequency THD.

A pouch, etc. may be used to fill the porous materials 30 in the resonance space in such a manner that the porous materials 30 are filled in a pouch formed from a screen filter material, and then the pouch filled with the porous materials 30 is attached to the resonance space.

SUMMARY

An object of the present invention is to provide a microspeaker enclosure with both porous materials and a sound absorber in a resonance space, for increasing low-frequency SPL and decreasing low-frequency THD.

According to an aspect of the present invention, there is provided a microspeaker enclosure with porous materials, including a microspeaker, an enclosure with the microspeaker therein, the enclosure defining a resonance space and having an upper casing and a lower casing, a sound absorber arranged in the resonance space and defining a space, and porous materials filled in the space defined by the sound absorber.

In some embodiments, the sound absorber is formed in a pouch shape.

In some embodiments, the sound absorber includes a first sound absorber portion defining a space with one surface open, a second sound absorber portion covering the open surface of the first sound absorber portion, and a fixing member fixing the first sound absorber portion and the second sound absorber portion to each other.

In some embodiments, the fixing member is a tape attached to the first sound absorber portion and the second sound absorber portion.

In some embodiments, the sound absorber includes a middle sound absorber portion defining a space with top and bottom surfaces open, a lower sound absorber portion covering the bottom surface of the middle sound absorber portion, and an upper sound absorber portion covering the top surface of the middle sound absorber portion.

In some embodiments, the upper sound absorber portion and the lower sound absorber portion are attached to the middle sound absorber portion by a tape.

In some embodiments, the sound absorber includes a first sound absorber portion defining a space with top and bottom surfaces open, a film covering either the top surface or the bottom surface of the first sound absorber portion, and a second sound absorber portion covering the other surface of the first sound absorber portion.

In some embodiments, the sound absorber includes a sound absorber portion defining a space with top and bottom surfaces open and films covering the open surfaces of the sound absorber.

The microspeaker enclosure with the porous materials according to the present invention can advantageously improve low-frequency SPL and low-frequency THD, by both the porous materials and the sound absorber, by filling the porous materials in the pouch, which is the sound absorber, and then arranging the pouch in the resonance space.

Those skilled in the art will recognize additional features and advantages upon reading the following detailed description, and upon viewing the accompanying drawings.

DETAILED DESCRIPTION

Hereinafter, preferred embodiments of a microspeaker enclosure with porous materials in a resonance space according to the present invention will be described in detail with reference to the accompanying drawings.

Figure 1:
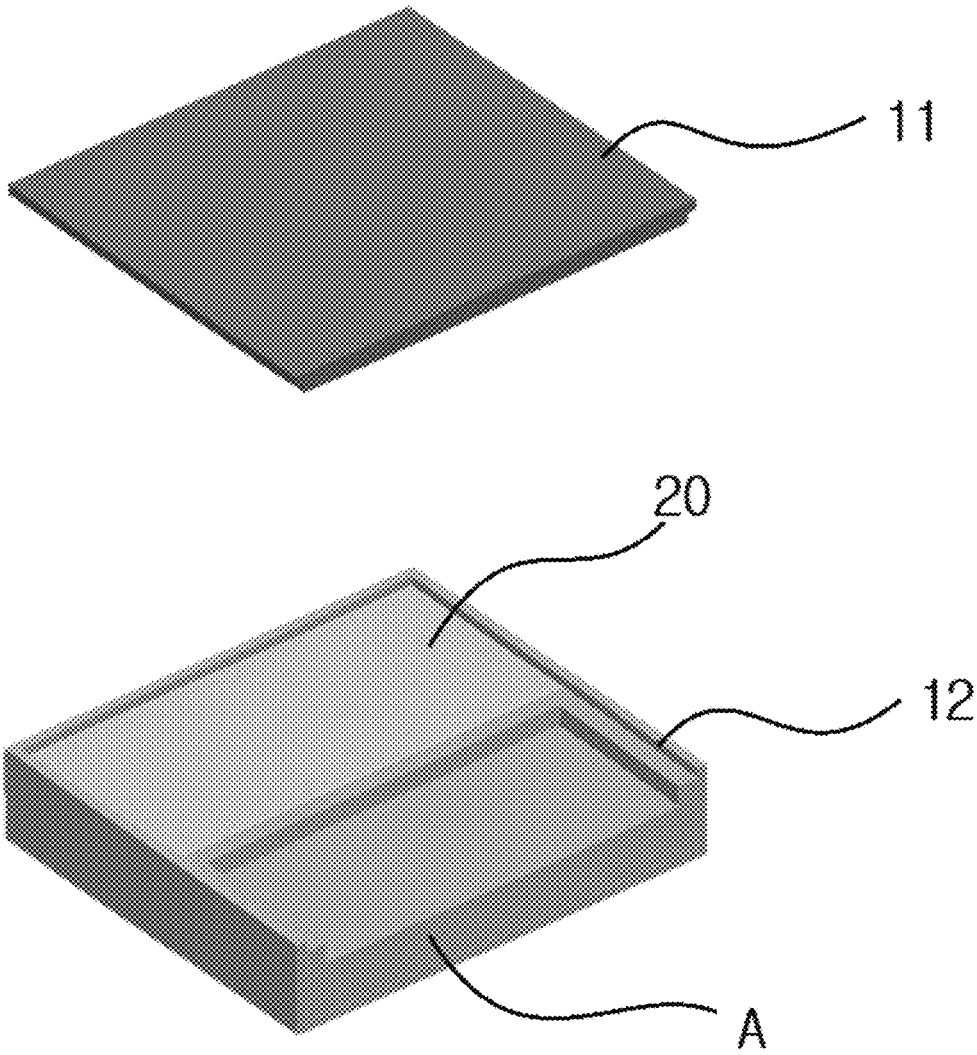
FIG. 1 illustrates a conventional microspeaker enclosure with a sound absorber.
Figure 2:
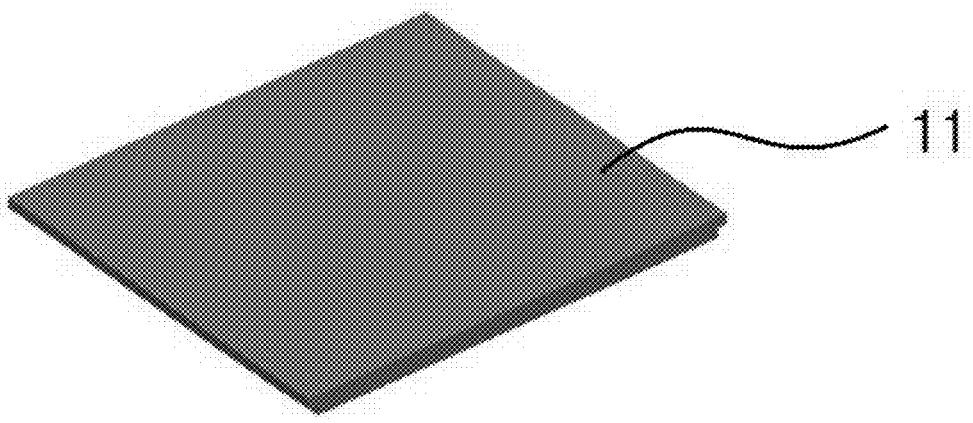
FIG. 2 illustrates a conventional microspeaker enclosure with porous materials.
Figure 2:
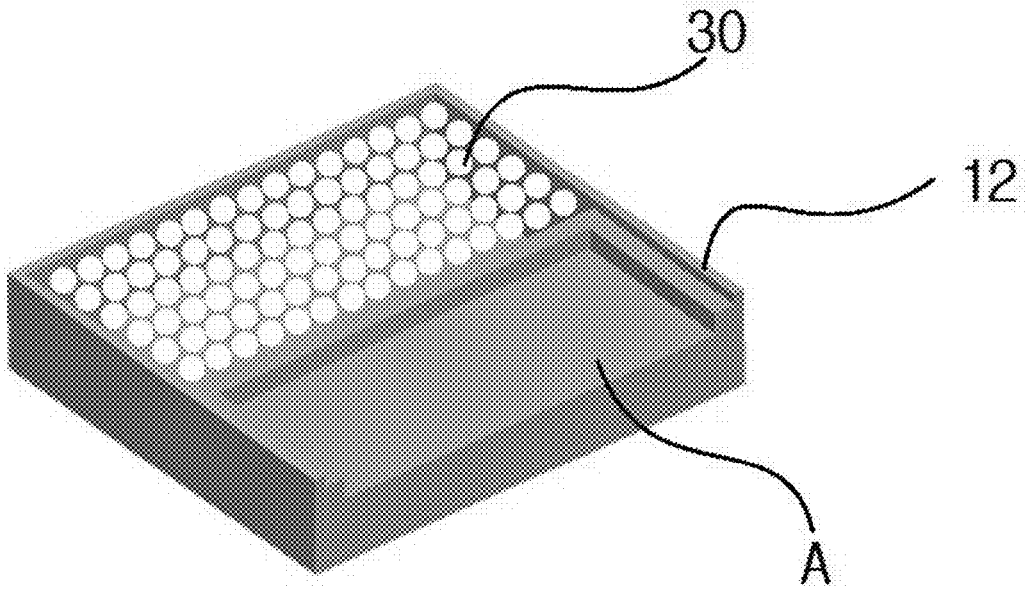
Figure 3:
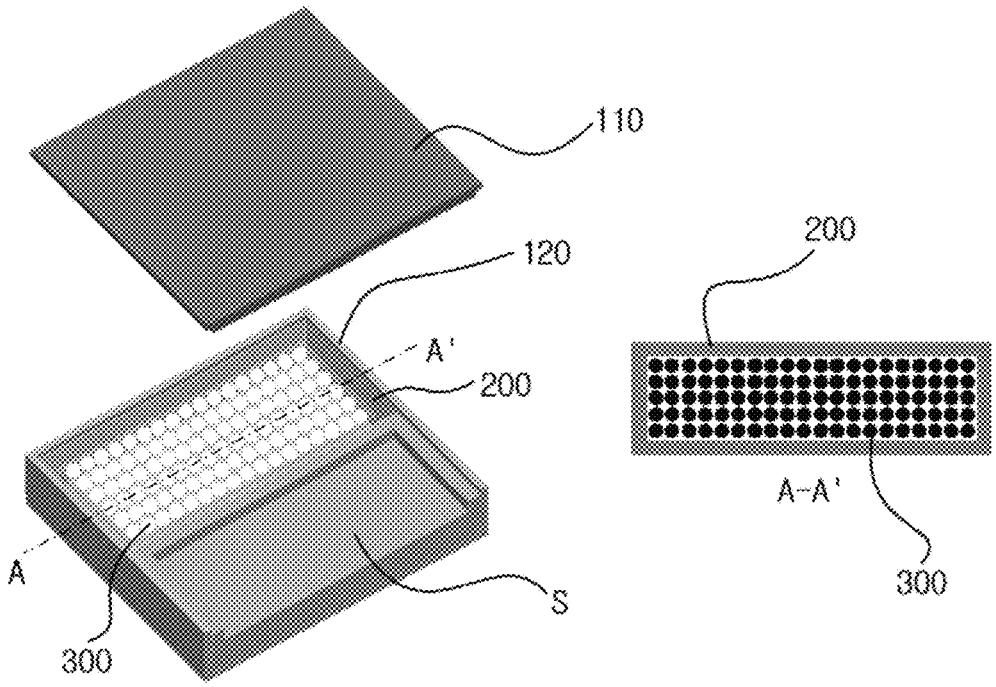
FIG. 3 illustrates a microspeaker enclosure with porous materials according to a first embodiment of the present invention.

FIG. 3 illustrates a microspeaker enclosure with porous materials according to a first embodiment of the present invention.

The microspeaker enclosure with the porous materials according to the first embodiment of the present invention includes a microspeaker S, an enclosure 100 with the microspeaker S therein, the enclosure defining a resonance space and having an upper casing 110 and a lower casing 120, and a sound absorber 200 and porous materials 300 arranged in the resonance space of the enclosure. According to the first embodiment of the present invention, the sound absorber 200 is formed in a hexahedral shape and arranged in the resonance space of the enclosure, and the porous materials 300 are filled in the hexahedral space defined by the sound absorber 200. Both the sound absorber 200 and the porous materials 300 serve to improve low-frequency SPL and low-frequency THD. In addition, when the porous materials 300 are filled in the resonance space, noise may be generated due to the collision between the porous materials 300 and the enclosure or the collision between the porous materials 300 and the microspeaker S, which are caused by the sound generated by the microspeaker S, and also due to the introduction of the porous materials 300 into the microspeaker 5, as a result of which an anti-noise structure is necessary. That is, the sound absorber 200 which surrounds the porous materials 300 is arranged in the resonance space, which has a synergy effect that can improve low-frequency SPL and low-frequency THD by the sound absorber 200 and the porous materials 300 while preventing possible noise by the sound absorber 200.

Figure 4:
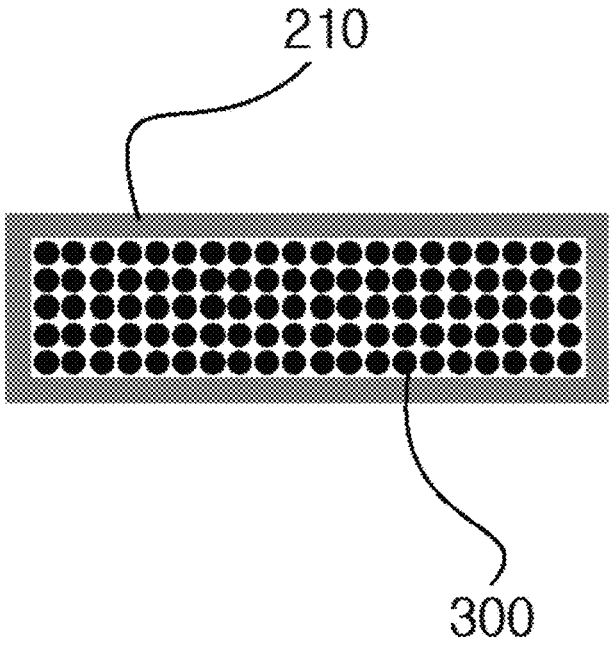
FIG. 4 illustrates a microspeaker enclosure with porous materials according to a second embodiment of the present invention.

FIG. 4 illustrates a microspeaker enclosure with porous materials according to a second embodiment of the present invention. In the microspeaker enclosure with the porous materials according to the second embodiment of the present invention, the porous materials 300 and a sound absorber 210 are previously prepared in a pouch shape, and then arranged in the resonance space during the assembly process of the microspeaker enclosure. Although the sound absorber 210 is formed in a pouch shape, it can be formed in any shape if it can retain the porous materials 300 therein. There is an advantage that the use of the sound absorber 210 and the porous materials 300 which are previously prepared in a pouch shape can reduce the assembly time of the microspeaker enclosure and simplify the assembly process thereof.

Figure 5:
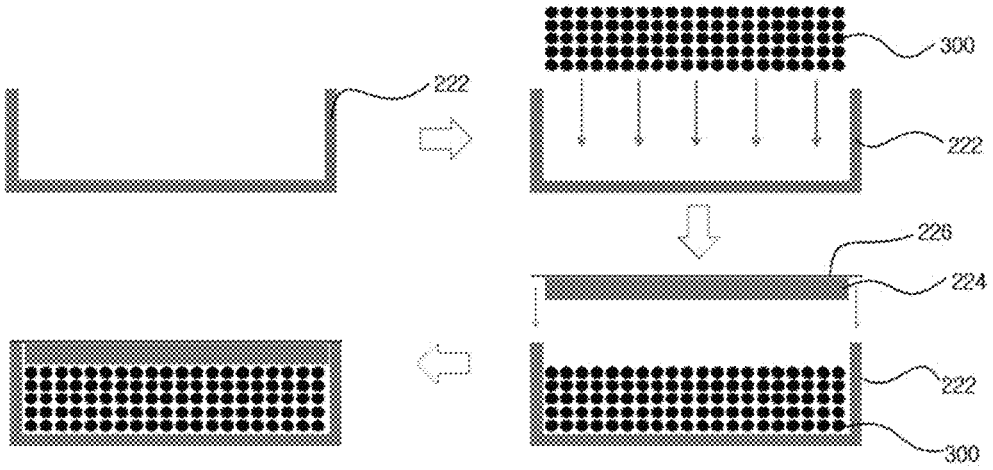
FIG. 5 illustrates a microspeaker enclosure with porous materials according to a third embodiment of the present invention.

FIG. 5 schematically illustrates a process of manufacturing a microspeaker enclosure with porous materials according to a third embodiment of the present invention.

The microspeaker enclosure according to the third embodiment of the present invention is the same as the microspeaker enclosure according to the second embodiment of the present invention in that a pouch prepared by filling the porous materials 300 in a sound absorber 222 and 224 is arranged in the resonance space.

More specifically, the pouch provided in the microspeaker enclosure according to the third embodiment of the present invention includes a first sound absorber portion 222 defining a space with one surface open, a second sound absorber portion 224 covering the open surface of the first sound absorber portion 222, and a fixing member 226 fixing the first sound absorber portion 222 and the second sound absorber portion 224 to each other, the porous materials 300 being filled in the space defined by the first sound absorber portion 222 and the second sound absorber portion 224.

The space defined by the first sound absorber portion 222 and the second sound absorber portion 224 can be formed in any shape, without special limitation, if it can be easily arranged in the resonance space.

Moreover, the fixing member 226 is preferably a film-type tape with an adhesive surface. The entire top surface of the second sound absorber portion 224 and the edges of the open surface of the first sound absorber portion 222 are attached to the tape, so that the first sound absorber portion 222 and the second sound absorber portion 224 can be coupled and fixed to each other. Firstly, the second sound absorber portion 224 is attached to the tape, and then the edges of the tape are attached to the edges of the open surface of the first sound absorber portion 222, so that the first sound absorber portion 222 and the second sound absorber portion 224 can be more easily and simply coupled to each other.

Figure 6:
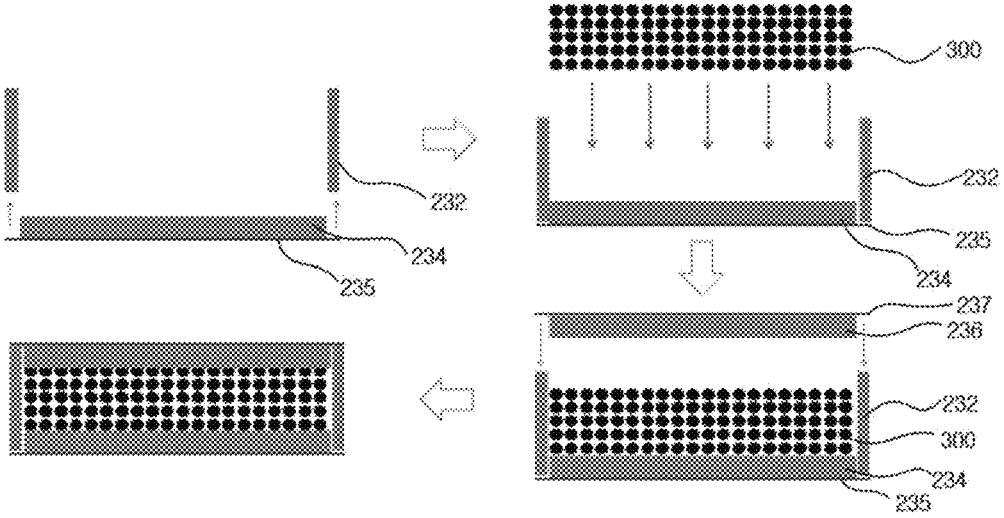
FIG. 6 illustrates a microspeaker enclosure with porous materials according to a fourth embodiment of the present invention.

FIG. 6 schematically illustrates a process of manufacturing a microspeaker enclosure with porous materials according to a fourth embodiment of the present invention.

The microspeaker enclosure according to the fourth embodiment of the present invention is the same as the microspeaker enclosures according to the second and third embodiments of the present invention in that the pouch filled with the porous materials 300 is arranged in the resonance space.

More specifically, the pouch provided in the microspeaker enclosure according to the fourth embodiment of the present invention includes a middle sound absorber portion 232 defining a space with top and bottom surfaces open, a lower sound absorber portion 234 covering the bottom surface of the middle sound absorber portion 232, a first fixing member 235 fixing the middle sound absorber portion 232 and the lower sound absorber portion 234 to each other, an upper sound absorber portion 236 covering the top surface of the middle sound absorber portion 232, and a second fixing member 237 fixing the middle sound absorber portion 232 and the upper sound absorber portion 234 to each other, the porous materials 300 being filled in the space defined by the middle sound absorber portion 232, the lower sound absorber portion 234, and the upper sound absorber portion 236.

The space defined by the middle sound absorber portion 232, the lower sound absorber portion 234 and the upper sound absorber portion 236 can be formed in any shape, without special limitation, if it can be easily arranged in the resonance space.

Moreover, the fixing members 235 and 237 are preferably film-type tapes with an adhesive surface. The entire top surface of the lower sound absorber portion 234 and the edges of the lower open surface of the middle sound absorber portion 232 are attached to the tape, so that the middle sound absorber portion 232 and the lower sound absorber portion 234 can be coupled and fixed to each other. Additionally, the entire top surface of the upper sound absorber portion 236 and the edges of the upper open surface of the middle sound absorber portion 232 are attached to the tape, so that the middle sound absorber portion 232 and the upper sound absorber portion 236 can be coupled and fixed to each other. Firstly, the lower and upper sound absorber portions 234 and 236 are attached to the tape, and then the edges of the tape are attached to the edges of the open surface of the middle sound absorber portion 232, so that the middle sound absorber portion 222 and the lower and upper sound absorber portions 234 and 236 can be more easily and simply coupled to each other.

Figure 7:
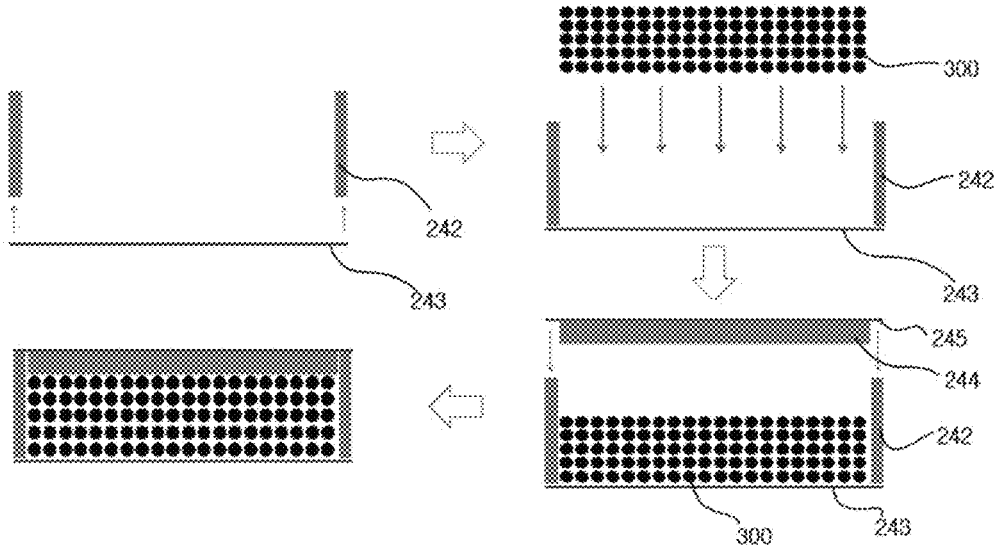
FIG. 7 illustrates a microspeaker enclosure with porous materials according to a fifth embodiment of the present invention.

FIG. 7 schematically illustrates a process of manufacturing a microspeaker enclosure with porous materials according to a fifth embodiment of the present invention.

The microspeaker enclosure according to the fifth embodiment of the present invention is the same as the microspeaker enclosures according to the second to fourth embodiments of the present invention in that the pouch filled with the porous materials 300 is arranged in the resonance space.

More specifically, the pouch provided in the microspeaker enclosure according to the fifth embodiment of the present invention includes a first sound absorber portion 242 defining a space with top and bottom surfaces open, a film 243 covering any one of the open surfaces of the first sound absorber portion 242, a second sound absorber portion 244 covering the other open surface of the first sound absorber portion 242, and a fixing member 245 fixing the first sound absorber portion 242 and the second sound absorber portion 244 to each other, the porous materials 300 being filled in the space defined by the first sound absorber portion 242, the second sound absorber portion 244, and the film 243. As can be seen in FIG. 7, the film 243 is attached to the bottom surface of the first sound absorber portion 242, and the second sound absorber portion 244 is attached to the top surface of the first sound absorber portion 242.

The space defined by the first sound absorber portion 242, the second sound absorber portion 244 and the film 243 can be formed in any shape, without special limitation, if it can be easily arranged in the resonance space.

Moreover, the fixing member 245 is preferably a film-type tape with an adhesive surface. The entire top surface of the second sound absorber portion 244 and the edges of the upper open surface of the first sound absorber portion 242 are attached to the tape, so that the first sound absorber portion 242 and the second sound absorber portion 244 can be coupled and fixed to each other. Additionally, the film 243 may be applied with an adhesive only in its edges, or analogously to the second sound absorber portion 244, the tape may be attached to the bottom surface of the film 243, and then the tape may be attached to the edges of the lower open surface of the first sound absorber portion 242. Alternatively, a separation sheet of the tape to be attached to the edges of the open surface of the first sound absorber portion 242 may only be removed, and then the tape may be attached to the first sound absorber portion 242. That is, at this time, the separation sheet of the tape can be regarded as one example of the film 243.

A double-sided tape may be used as the film 243. A separation sheet of the tape to be attached to the edges of the open surface of the first sound absorber portion 242 is only removed, and then the tape is attached to the first sound absorber portion 242, and a separation sheet of the tape which is not in contact with the first sound absorber portion 242 is left. Thereafter, when the completed pouch is attached to the resonance space of the microspeaker enclosure, the separation sheet of the tape which is not in contact with the first sound absorber portion 242 is removed, which facilitates the pouch to be easily attached to the resonance space.

Figure 8:
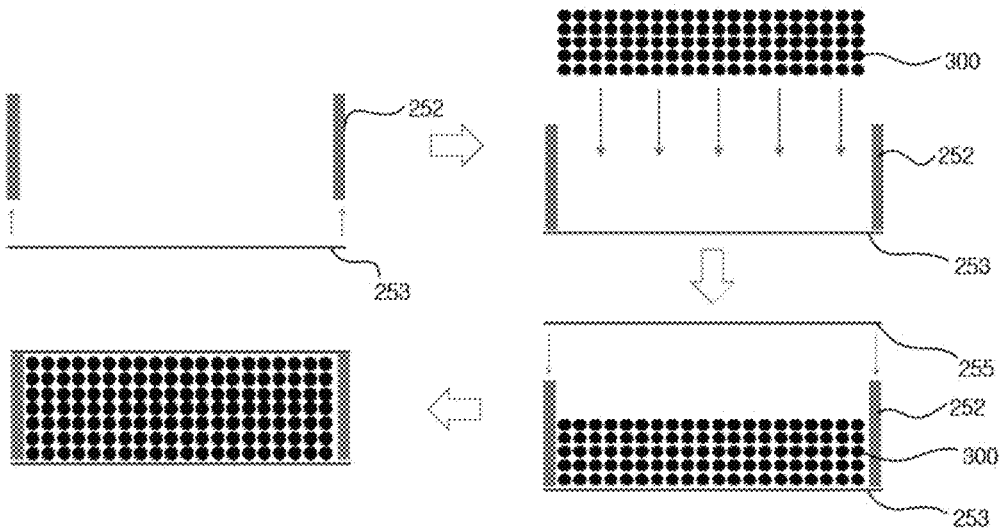
FIG. 8 illustrates a microspeaker enclosure with porous materials according to a sixth embodiment of the present invention.

FIG. 8 schematically illustrates a process of manufacturing a microspeaker enclosure with porous materials according to a sixth embodiment of the present invention.

The microspeaker enclosure according to the sixth embodiment of the present invention is the same as the microspeaker enclosures according to the second to fifth embodiments of the present invention in that the pouch filled with the porous materials 300 is arranged in the resonance space.

More specifically, the pouch provided in the microspeaker enclosure according to the sixth embodiment of the present invention includes a sound absorber portion 252 defining a space with top and bottom surfaces open, a lower film 253 covering the bottom surface of the sound absorber portion 252, and an upper film 255 covering the top surface of the sound absorber portion 252, the porous materials 300 being filled in the space defined by the sound absorber portion 252, the lower film 253, and the upper film 255.

The space defined by the sound absorber portion 252, the lower film 253 and the upper film 255 can be formed in any shape, without special limitation, if it can be easily arranged in the resonance space.

Additionally, the upper and lower films 255 and 253 may be applied with an adhesive only in their edges, or the tapes may be attached to the bottom surfaces of the films 255, 253, and then the tapes may be attached to the edges of the open surfaces of the sound absorber portion 252. Alternatively, separation sheets of the tapes to be attached to the edges of the open surfaces of the sound absorber portion 252 may only be removed, and then the tapes may be attached to the sound absorber portion 252. That is, at this time, the separation sheets of the tapes can be regarded as one example of the upper and lower films 255 and 253.

In addition, double-sided tapes may be used as the upper and lower films 255 and 253. Separation sheets of the tapes to be attached to the edges of the open surfaces of the sound absorber portion 252 are only removed, and then the tapes are attached to the sound absorber portion 252, and separation sheets of the tapes which are not in contact with the sound absorber portion 252 are left. Thereafter, when the completed pouch is attached to the resonance space of the microspeaker enclosure, the separation sheets of the tapes which are not in contact with the sound absorber portion 252 are removed, which facilitates the pouch to be easily attached to the resonance space.

As used herein, the terms "having", "containing", "including", "comprising" and the like are open-ended terms that indicate the presence of stated elements or features, but do not preclude additional elements or features. The articles "a", "an" and "the" are intended to include the plural as well as the singular, unless the context clearly indicates otherwise.

While the present invention has been illustrated and described in connection with the accompanying drawings and the preferred embodiments, the present invention is not limited thereto and is defined by the appended claims. Instead, the present invention is limited only by the following claims and their legal equivalents. Therefore, it will be understood by those skilled in the art that various modifications and changes can be made thereto without departing from the spirit and scope of the invention defined by the appended claims.

What is claimed is:

1. A microspeaker enclosure with porous materials, comprising:

a microspeaker;

an enclosure with the microspeaker therein, the enclosure defining a resonance space and having an upper casing and a lower casing;

a sound absorber arranged in the resonance space and defining a space; and porous materials filled in the space defined by the sound absorber, wherein the sound absorber comprises a first sound absorber portion defining a space with one surface open, a second sound absorber portion covering the open surface of the first sound absorber portion, and a fixing member fixing the first sound absorber portion and the second sound absorber portion to each other, wherein the fixing member is a tape attached to the first sound absorber portion and the second sound absorber portion.

2. A method of manufacturing a microspeaker enclosure with porous materials, the method comprising:

placing a microspeaker in an enclosure, the enclosure defining a resonance space and having an upper casing and a lower casing;

arranging a sound absorber in the resonance space, the sound absorber defining a space; and filling the space defined by the sound absorber with porous materials, wherein arranging the sound absorber in the resonance space comprises:

providing a first sound absorber portion defining a space with one surface open;

covering the open surface of the first sound absorber portion with a second sound absorber portion; and fixing the first sound absorber portion and the second sound absorber portion to each other by a fixing member, wherein fixing the first sound absorber portion and the second sound absorber portion to each other by the fixing member comprises:

attaching the first sound absorber portion and the second sound absorber portion to each other by a tape.

3. A microspeaker enclosure with porous materials, comprising:

a microspeaker;

an enclosure with the microspeaker therein, the enclosure defining a resonance space and having an upper casing and a lower casing;

a sound absorber arranged in the resonance space and defining a space; and porous materials filled in the space defined by the sound absorber, wherein the sound absorber comprises a middle sound absorber portion defining a space with top and bottom surfaces open, a lower sound absorber portion covering the bottom surface of the middle sound absorber portion, and an upper sound absorber portion covering the top surface of the middle sound absorber portion.

4. The microspeaker enclosure of claim 3, wherein the upper sound absorber portion and the lower sound absorber portion are attached to the middle sound absorber portion by a tape.

5. A microspeaker enclosure with porous materials, comprising:

a microspeaker;

an enclosure with the microspeaker therein, the enclosure defining a resonance space and having an upper casing and a lower casing;

a sound absorber arranged in the resonance space and defining a space; and porous materials filled in the space defined by the sound absorber, wherein the sound absorber comprises a first sound absorber portion defining a space with top and bottom surfaces open, a film covering either the top surface or the bottom surface of the first sound absorber portion, and a second sound absorber portion covering the other surface of the first sound absorber portion.

6. A microspeaker enclosure with porous materials, comprising:

a microspeaker;

an enclosure with the microspeaker therein, the enclosure defining a resonance space and having an upper casing and a lower casing;

a sound absorber arranged in the resonance space and defining a space; and porous materials filled in the space defined by the sound absorber, wherein the sound absorber comprises a sound absorber portion defining a space with top and bottom surfaces open and one or more films covering the top and bottom surfaces of the sound absorber.

7. A method of manufacturing a microspeaker enclosure with porous materials, the method comprising:

placing a microspeaker in an enclosure, the enclosure defining a resonance space and having an upper casing and a lower casing;

arranging a sound absorber in the resonance space, the sound absorber defining a space; and filling the space defined by the sound absorber with porous materials, wherein arranging the sound absorber in the resonance space comprises:

providing a middle sound absorber portion defining a space with top and bottom surfaces open;

covering the bottom surface of the middle sound absorber portion with a lower sound absorber portion; and covering the top surface of the middle sound absorber portion with an upper sound absorber portion.

8. The method of claim 7, further comprising:

attaching the upper sound absorber portion and the lower sound absorber portion to the middle sound absorber portion by a tape.

9. A method of manufacturing a microspeaker enclosure with porous materials, the method comprising:

placing a microspeaker in an enclosure, the enclosure defining a resonance space and having an upper casing and a lower casing;

arranging a sound absorber in the resonance space, the sound absorber defining a space; and filling the space defined by the sound absorber with porous materials, wherein arranging the sound absorber in the resonance space comprises:

providing a first sound absorber portion defining a space with top and bottom surfaces open;

covering either the top surface or the bottom surface of the first sound absorber portion with a film; and covering the other surface of the first sound absorber portion with a second sound absorber portion.

10. A method of manufacturing a microspeaker enclosure with porous materials, the method comprising:

placing a microspeaker in an enclosure, the enclosure defining a resonance space and having an upper casing and a lower casing;

arranging a sound absorber in the resonance space, the sound absorber defining a space; and filling the space defined by the sound absorber with porous materials, wherein arranging the sound absorber in the resonance space comprises:

providing a sound absorber portion defining a space with top and bottom surfaces open; and covering the open surfaces of the sound absorber with one or more films.

* * * * *